United States Patent [19]

Henderson et al.

[11] Patent Number: 4,945,356

[45] Date of Patent: Jul. 31, 1990

[54] STRIP MATERIAL FOR AND A SURFACE MOUNTED INDUCTIVE LOOP

[75] Inventors: Martin C. Henderson, Los Angeles; Ralph J. Koerner, Ramona; William D. Jordan, Jr., Los Angeles, all of Calif.

[73] Assignee: Minnesota Mining and Manufacturing Company, St. Paul, Minn.

[21] Appl. No.: 502,562

[22] Filed: Jun. 9, 1983

[51] Int. Cl.[5] ..... G08G 1/01

[52] U.S. Cl. ..... 340/941; 340/933

[58] Field of Search ..... 340/941, 905, 51, 52 R, 340/568, 933; 377/9; 343/897

[56] References Cited

U.S. PATENT DOCUMENTS

| | | | |
|---|---|---|---|
| 3,047,860 | 7/1962 | Swallow et al. | 343/897 |
| 3,132,114 | 9/1955 | Somigliana | 260/28.5 |
| 3,609,678 | 9/1971 | Fayling | 340/905 |
| 3,723,988 | 3/1973 | Kardashian | 340/941 |
| 3,748,443 | 7/1973 | Kroll et al. | 377/9 |
| 3,943,339 | 3/1976 | Koerner et al. | 235/92 |
| 3,984,764 | 10/1976 | Koerner | 324/41 |
| 3,989,932 | 11/1976 | Koerner | 235/92 |
| 4,080,085 | 3/1978 | Dickson | 404/14 |
| 4,117,192 | 9/1978 | Jorgensen | 428/337 |
| 4,449,115 | 5/1984 | Koerner | 340/941 |

FOREIGN PATENT DOCUMENTS

| | | | |
|---|---|---|---|
| 2015875 | 4/1970 | Fed. Rep. of Germany | 340/941 |
| 7345069 | 12/1973 | France | 340/941 |

OTHER PUBLICATIONS

Originator: Golden River Corporation, Title: Adhesive Surface Loop Kit and Thermoplastic Surface Loop Kit.
Originator: Geo Merkel GmbH & Co. KG, Title: Induktionsplatte.
Originator: Universal Autopayment Ltd., Title: Vehicle Detector 4BA.

*Primary Examiner*—Alvin Oberley
*Assistant Examiner*—M. Fatahiyar
*Attorney, Agent, or Firm*—Donald M. Sell; Walter N. Kirn; William D. Bauer

[57] ABSTRACT

A strip material (18) for forming an inductive loop (10) adapted to be applied to the surface of a roadway (12). The strip material (18) consists of and the loop (10) is formed from a ductile, flexible, flattened, extensible conductor (20) and a protective covering (22). A protective underlayment (24) is optional. The conductor (20) may be formed from a compressed, flattened metallic wire braid (28) or from a wire mesh containing 25% to 75% voids. The protective covering (22) may be formed from either combination unvulcanized elastomer precursor base sheet (30) and a vinyl based polymer support film (32), or a covering (26) selected from the group of epoxy, polyester, urethane and polyurethane.

23 Claims, 4 Drawing Sheets

STRIP MATERIAL FOR AND A SURFACE MOUNTED INDUCTIVE LOOP

BACKGROUND OF THE INVENTION

The present invention relates generally to inductive loops intended for vehicle detection and more particularly to surface mounted inductive loops intended for vehicle detection and more particularly to strip material for forming such loops.

Inductive loops are well known in the art for use in vehicle detection. See for example, U.S. Pat. No. 3,989,932, Koerner, entitled Inductive Loop Vehicle Detector; U.S. Pat. No. 3,984,764, Koerner, entitled Inductive Loop Structure; and U.S. Pat. No. 3,943,339, Koerner, Inductive Loop Vehicle Detector. Generally these loops consist of one of more loops (turns) of a conductive wire embedded under the surface of a roadway over which the vehicle to be detected passes. For example, the inductive loop may be embedded in the street to detect vehicles in the roadway approaching an intersection. Typically, a six foot (1.8 meters) across circular or nearly square loop is utilized along with a lead wire leading from the loop to the side of the roadway. The loop may then be connected via the lead wire to well known devices which typically oscillate the loop at a predetermined frequency and monitor changes in the frequency in order to detect the presence of a vehicle over the inductive loop. Examples of these well known devices are described in the above-referenced patents.

These typical prior art loops which are embedded in the roadway require the cutting of the roadway in order to install the loops. Typically saw cuts are made in the roadway to allow for the installation of the loops. Saw cuts impair the integrity of the roadway and facilitate entry of moisture which may dilatoriously affect the roadway, e.g. during freeze-thaw-freeze cycles, and jeopardize the strength of the roadway by creating a "weak" spot which may facilitate uneven settling or shifting of the roadway under heavy vehicular loads. In some installations it may be impossible to saw cut the surface of the roadway on which the inductive loop is to be installed. An example where this may be the case is a parking ramp constructed from precast, prestressed concrete slabs where the saw cutting of the slabs may seriously weaken the structure.

A few inductive loops exist which are intended for mounting on the surface of a roadway. When surface mounted, the loop is subject to the stress of the vehicular traffic over it, whether it be high speed, heavy truck traffic in a roadway application or turning wheels in a parking application. Further, the surface mounted loop is subject to exposure to the elements in the form of rain, snow and corrosive materials. Still further, the surface mounted loop is subject to the uneven shifting in the roadway and the resultant uneven surface of the roadway to which the loop must conform.

Golden River Corporation of 7315 Redfield Court, Falls Church, Va. has manufactured a surface mounted inductive loop. The loop is a temporary surface loop for vehicle counting and classifying. The loop uses an adhesive, a protective ribbon, a loop wire, plugs and siliconized scissors for installation. The loop uses a standard continuous metallic conductor for forming the loop conductor and hence is relatively inextensible and subject to breakage on stretch as may be caused by the uneven surface or shifting of a roadway.

A device known as an INDUKTIONSPLATTE produced by GEO Merkel GmbH and Co. KG of West Germany uses a preformed detector loop built into a plastic plate and is indicated as suitable for mounting on the surface of a roadway. The plastic plate is relatively inflexible and utilizes a conductor of a uniform copper with a wire size of approximately number AWG 25.5.

Universal Autopayment, Ltd. of Morley Road, Tonbridge, Kent manufactures an inductive loop surface tape which has been designed for use as a substitute for buried loops. The tape comprises 21 specially designed copper strands which provide a multiplicity of conductive paths allowing the loop to continue to function if some of the conductive paths are broken.

These prior art surface mounted inductive loops attempt to solve the breakage problem either by preventing deformation (INDUKTIONSPLATTE) or by providing a multiplicity of paths (Universal Autopayment) such that if some breakage occurs the loop would still function.

SUMMARY OF THE INVENTION

The present invention provides a strip material for forming an inductive loop and an inductive loop adapted to be applied to the surface of a roadway. The inductive loop consists of a loop of ductile, flexible, flattened, extensible conductor and a protective covering adhered to the loop and being capable of adhering the loop to the surface of the roadway. In preferred embodiments the conductor is metallic and is a flattened, braided wire which is longitudinally compressed preferrably to be not more than three-fourths of its extended length. In an alternative embodiment the conductor may be a flattened, braided wire which is constructed from a soft metal such as copper and still preferrably be a wire mesh which has a surface area containing from 25% to 75% voids and wherein such voids may be diamond shaped. In one embodiment the protective covering may have a base sheet, a support film adhered to one surface of the base sheet, and in a preferred embodiment an adhesive affixed to the other side of the base sheet for adhering the wire to the protective covering and for being capable of adhering the inductive loop to the roadway. The base sheet may be an unvulcanized elastomer precursor and the support film may be a vinyl based polymer and may further contain irregular skid resisting particles partially embedded in and partially exposed out of the support sheet. In an alternative embodiment the protective covering may be selected from a group consisting of epoxy, polyester, urethane, and polyurethane and in a preferred embodiment is an ultraviolet curable polyurethane. In another embodiment the inductive loop further has a protective underlayment placed between the conductor and the surface of the roadway which may be insulative and in a preferred embodiment is an adhesive.

The present invention provides a solution for the aforementioned problems in connection with surface mounted inductive loops. The present invention provides a strip material for an inductive loop and an inductive loop intended for surface mounting particularly in a roadway and parking areas such as parking ramps. The strip material and inductive loop eliminates the need for saw cutting the surface of the roadway. The material and loop has elasticity, which is required to avoid breakage due to uneven shifting or flexing of the surface of the roadway under frequent or heavy traffic loads, thermal expansion, or structural settling. Further the material and inductive loop conforms easily to the uneven surface of the roadway including cracks and crevices. The present invention provides a protective layer over a conductor to protect the conductor from the elements and wear from vehicular traffic. A major problem in surface mounted inductive loops has been to find a flexible, extensible conductor to be constructed from generally inextensible metallic conductors. The surface mounted loop of the present invention can also be used for temporary installations because the roadway surface is not damaged. An example would be to use the surface mounted loop to obtain a traffic count to replace generally inaccurate pressure tubes.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENTS

Figure 1:
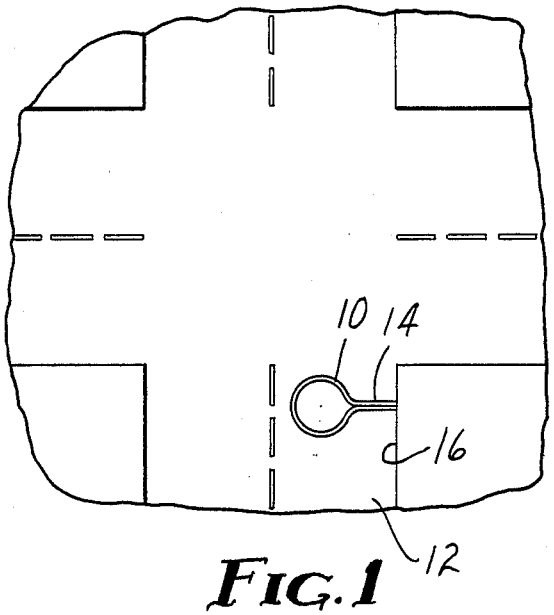
FIG. 1 is a top view showing an inductive loop installed on a roadway surface near an intersection.
Figure 2:
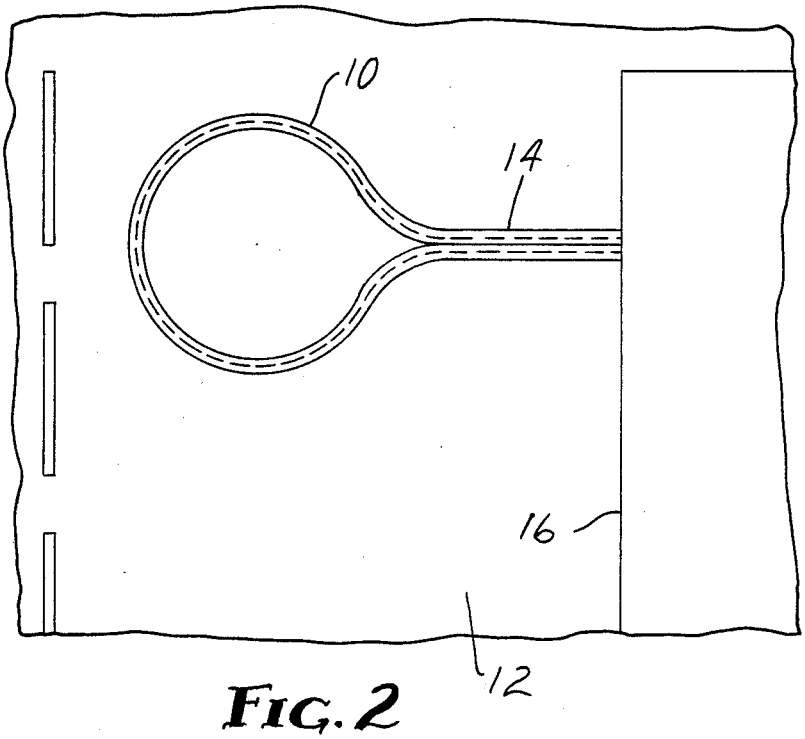
FIG. 2 is a close up view of the inductive loop of FIG. 1.

FIGS. 1 and 2 illustrate a surface mounted inductive loop 10 mounted on the surface of a roadway 12 with a lead wire 14 connecting the inductive loop 10 to the edge 16 of the roadway 12. The inductive loop 10 is designed to be coupled via lead wire 14 to a well known vehicle detector such as those described in the '932 Koerner and '339 Koerner patents, both of which are hereby incorporated by reference. The inductive loop 10 illustrated in FIGS. 1 and 2 is shown to be in a generally circular shape and is placed in the roadway 12 in a position designed such that the traffic to be detected passes over the inductive loop 10. In preferred embodiments of the present invention circular shapes for the inductive loop 10 of 3 feet (0.91 meters) and 4 feet (1.22 meters) diameters are preferred so that the inductive loop 10 may be placed between the wheels of the vehicular traffic in the roadway 12.

The inductive loop 10 is placed in a location of the roadway 12 where it is desired to detect the vehicles. The inductive loop 10 is placed in the traffic lane of the roadway 12 approaching the intersection. The inductive loop 10 could be used with traffic sensitive semaphores (traffic signals) or could be used for temporary or relatively permanent traffic counters. In FIGS. 1 and 2 only one inductive loop and associated lead wire 14 are illustrated. However, it is anticipated that there may be at least one inductive loop 10 at each approach to the intersection which is to be monitored and in other installations there may be one or more inductive loops 10 for each lane of vehicular traffic for each approach to the intersection. The inductive loop 10 may also be used for non-roadway applications. Examples would be use in parking areas to monitor ingress and egress as well as to monitor parking space occupancy. The inductive loop 10 can detect any conductive object of sufficient size relative to the size of the inductive loop 10 and need not be limited to the detection of only vehicles.

Figure 3:
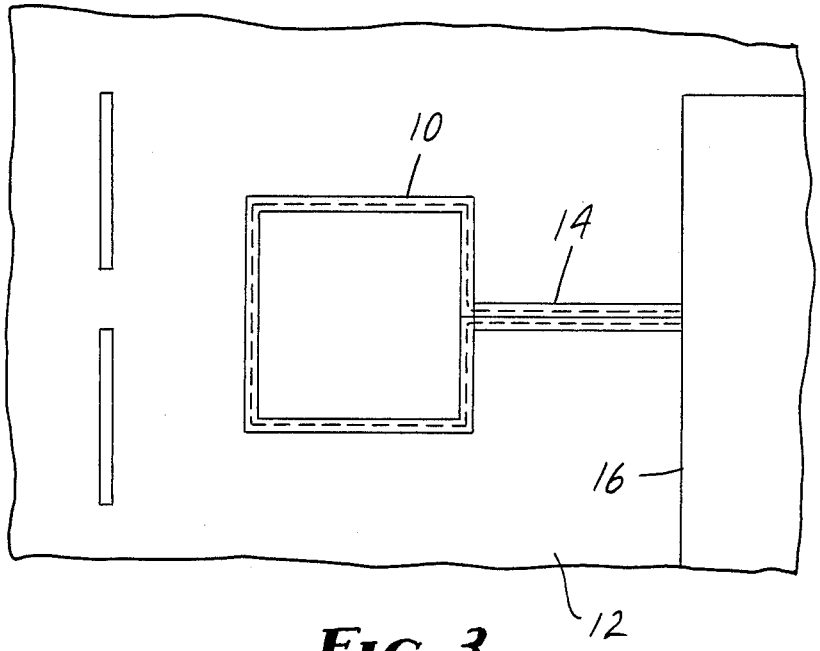
FIG. 3 is an alternative geometric embodiment of the inductive loop of FIG. 2.

FIG. 3 illustrates an alternative geometric shape for the surface mounted inductive loop 10 which is again mounted on the surface of a roadway 12 with lead wire 14 connecting the inductive loop 10 to the edge 16 of the roadway 12. The inductive loop 10 illustrated in FIGS. 1 and 2 was of a generally circular shape while the inductive loop 10 illustrated in FIG. 3 is generally square. It is to be recognized and understood that the exact shape formed by the inductive loop 10 is not important as long as a general loop is formed of one or more turns of a conductor in the area over which a vehicle is desired to be detected. Whether the inductive loop 10 has a circular shape, a square shape, a triangular shape, etc. doesn't significantly matter.

The inductive loop 10 may be preformed into a specific shape or may be site-formed into the desired shape. That is, the inductive loop 10 may be distributed in strip material form or linear rolls to be formed into the circular, square or other desired shape at the site. Although it is generally preferred that the inductive loop 10 be formed from a continuous piece of the strip material, it could be formed from multiple discrete pieces of the strip material with conductive splices connecting the inductive loop where the discrete pieces are joined. Discrete pieces may be required for example with a square shaped inductive loop 10 as illustrated in FIG. 3 where a continuous piece of strip material cannot be formed around the sharp corners. If a splice in the strip material is required to form the inductive loop 10, it is preferred that the splice as described later with respect to FIG. 11 be utilized.

Figure 4:
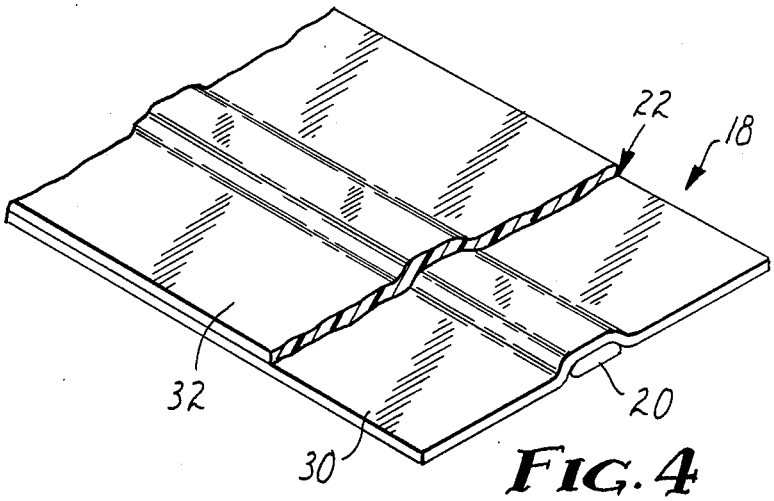
FIG. 4 illustrates the detailed construction of one embodiment of the strip material of the present invention.

FIG. 4 illustrates the detailed construction of an embodiment of the strip material 18 which can be used to form the surface mounted inductive loop 10. A conductor 20 is illustrated ready to be formed to the surface of the roadway 12 and is covered with a protective covering 22. In a preferred embodiment, the strip material 18 has a width of from 2 inches (5.1 centimeters) to 4 inches (10.2 centimeters) and has an indefinite length which is as long as need be to form an individual inductive loop 10 or which may be conveniently packaged as in a roll. The conductor 20 must be ductile, flexible and extensible. The conductor 20 must maintain its conductivity even though the roadway 12 may be subject to movements in its surface because the strip material 18 is placed over cracks in the roadway 12. The conductor 20 must be able to elongate and contract without breakage in the conductive path. In general, a conductor equivalent to a 20 gauge solid copper wire (having a resistance of about 0.033 ohms per meter at 20° C.) or larger conductor is sufficient to provide the required conductivity. The protective covering 22 must be able to protect the strip material 18 from the vehicular traffic in the roadway 12 and must further protect the strip material 18 from the elements, e.g. moisture and corrosive elements. In a preferred embodiment, an insulator is placed between the conductor 20 and the surface of the roadway 12. Although the strip material 18 is generally operable when formed into an inductive loop 10 and placed directly on the surface of a roadway 12 because the roadway 12 itself is usually a sufficient insulator. The presence of a separate insulator, however, between the conductor 22 and the surface of the roadway 12 would expand the operational environment of the strip material 18 and the resultant inductive loop 10.

Figure 5:
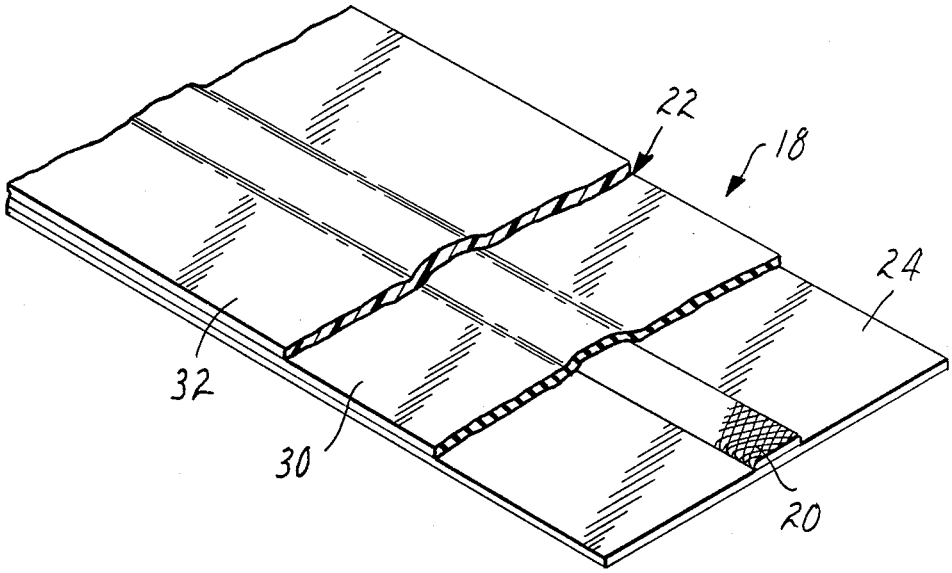
FIG. 5 illustrates a detailed construction of an alternative embodiment of the strip material of the present invention.

FIG. 5 illustrates an alternative embodiment of the strip material 14 which may be used to form the inductive loop 10. The construction of the strip material in FIG. 5 is very similar to the construction of the strip material 18 in FIG. 4 with conductor 20 and protective covering 22. In addition, the strip material 18 in FIG. 5 has a protective underlayment 24. The protective underlayment 24 may assist in providing a dimensionally stable environment for the conductor 20 and also may assist in insulating the conductor 20 from the surface of the roadway 12. In one preferred embodiment the protective underlayment 24 may take the form of an adhesive layer to be utilized to adhere the strip material 18 forming the inductive loop 10 to the surface of the roadway 12 and, again, also serves as an insulator between the conductor 20 and the surface of the roadway 12.

A material which is similar to a preferred material for the protective covering 22 and, in certain circumstances, the protective underlayment 24 is described in U.S. Pat. No. 4,117,192, Jorgensen, DEFORMABLE RETROREFLECTIVE PAVEMENT-MARKING SHEET MATERIAL, which is hereby incorporated by reference. However, the material described in Jorgensen is not quite suitable for use in the strip material 18 of the present invention. The material in Jorgensen is designed to be easily seen on the roadway 12 since its purpose is for the marking of pavements. Hence, the material in Jorgensen has retroreflective elements designed to easily reflect incident light and further is of a color designed to easily attract attention. In contrast, strip material 18 for forming an inductive loop typically is best when it is not seen by the driver of a vehicle approaching the inductive loop 10. If the strip material 18 and inductive loop 10 is easily seen, the extra markings appearing on the surface of the roadway 12 may tend to confuse some drivers. Therefore, it is advantageous for the strip material 18 of the present invention which is to be utilized in forming an inductive loop 10 to be not very visible on the surface of the roadway 12. However the sheet material in Jorgensen has other desirable characteristics which can be utilized in the strip material 18 of the present invention, and particularly in the protective covering 22 and, in some circumstances, in the protective underlayment 24. The sheet material in Jorgensen is deformable, has elasticity, has a firm supporting structure and has adhesion to the surface of the roadway 12.

A preferred material for the protective covering 22 described in FIGS. 4 and 5 and, in some circumstances, the protective underlayment 24 in FIG. 5 would be a material which is similar to the sheet material described in Jorgensen. To be suitable, however, it would be desirable to modify the base film of the sheet material in Jorgensen. This modification would be primarily to effect a color change to adapt a color of the sheet material to a color as close as possible to the color of the surface of the roadway 12. One color which would be advantageous to develop and blend in to concrete roadways would be a grey color. Thus it is preferred that a sheet material as described in Jorgensen be developed but with a modified base sheet 32 (11 in Jorgensen). An example of such a modified base sheet 32 is a base sheet 32 constructed of the following ingredients substituted for those ingredients found in the Jorgensen patent:

| Ingredient | Parts Per Hundred |
|---|---|
| Hycar 1022 | 16.20 |
| Chlorowax 70-S | 11.37 |
| Chlorowax 40 | 2.48 |
| Sterling R Carbon Black | 1.07 |
| Calidria Asbestos RG 100 | 19.50 |
| Stearic Acid | 0.56 |
| Hi Sil 233 | 3.25 |
| 1.5 Refractive Index Glass Beads | 45.57 |
| Total | 100.00 |

A further necessary modification to the material described in Jorgensen is to eliminate the retroreflective particles (namely the transparent microspheres 14 in Jorgensen) of the support film 32 (12 in Jorgensen) leaving the skid resisting particles (13 in Jorgensen).

This modified sheet material can then be used as a protective covering 22 in FIGS. 4 and 5 to form the strip material 18 used to form the inductive loop 10. The conductor 20 can simply be pressed into the adhesive contained in the sheet material, either beforehand with pencil rollers under pressure or at the site while being applied to the surface of the roadway. Further it is preferred that in the embodiment of FIG. 4 that adhesive exists between the conductor 20 and the surface of the roadway. Adhesive similar to that in the Jorgensen patent may be used for this purpose. Alternatively, an entire adhesive layer may be formed on the underside of the protective covering 22 and conductor 20 as illustrated in FIG. 5. The adhesive would then form protective underlayment 24. Again, an adhesive similar to that described in the Jorgensen patent may be utilized for protective underlayment 24. Still further, an alternative embodiment of the strip material 18 illustrated in FIG. 5 would involve a double layer of the modified sheet material described in Jorgensen with the conductor 20 sandwiched between both layers, i.e. the sheet material modified as specified above could be used for both the protective covering 22 and the protective underlayment 24. Although more expensive, a strip material 18 constructed in this manner would allow for greater protection of the conductor 20 and ensure adequate insulation for the conductor 20 from the surface of the roadway 12.

Figure 6:
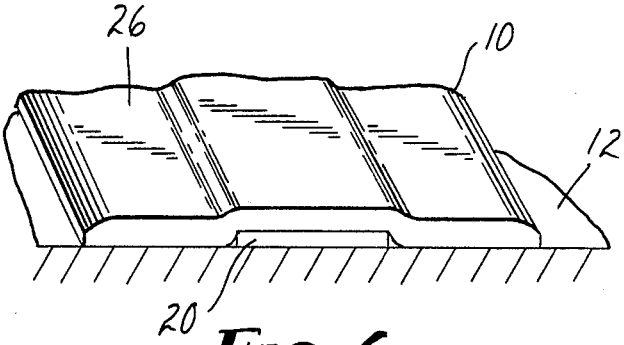
FIG. 6 illustrates a detailed construction of another alternative embodiment of the strip material and inductive loop of the present invention.

FIG. 6 illustrates an alternative embodiment of the manner in which the inductive loop 10 may be formed. In this alternative embodiment the inductive loop 10 is site formed on the surface of the roadway 12. The same conductor 20 as described in FIGS. 4 and 5 is utilized in FIG. 6. Protective covering 26, however, takes a different form. In the embodiment of FIG. 6, the conductor 20 is placed on the surface of the roadway 12 and the protective covering 26 is formed in place over the conductor 20, both protecting the conductor 20 and adhering the conductor 20 to the surface of the roadway 12. It is preferred that the conductor 20 also be separately adhered to the surface of the roadway 12 with an adhesive similar to the adhesive suggested with respect to FIGS. 4 and 5 which, again, also acts as an insulator between the conductor 20 and the surface of the roadway 12. Examples of a material which may be used to form protective covering 26 are polyurethane, urethane, polyester and epoxy. In a preferred embodiment, the protective covering 26 is a polyurethane and in a still preferred embodiment is an ultraviolet curable polyurethane. A preferred formula for the ultraviolet curable polyurethane is as follows:

| Ingredient | Manufacturer | Parts per Weight |
|---|---|---|
| Oligomer (PP4G6G) | | 40 |
| Monomer SR-306-Tripropylene Glycol Diacrylate | Sartomer | 17 |
| Quartz Filler Imsil A-10-Micronized Amorphous Silica | Illinois Mineral | 40 |
| Photo Initiator Irgacure 651 | Ciba Geigy | 2 |
| Parafin Wax | | 1 |
| Pigment, Lampblack | | 0.01 to 0.05% |

An example of the Oligomer would be the use of a polyester polyol, 1,4 butane diol neopentylglycol adipic acid, Lexorez 1640-55 (Inolex Corp.), MW 2000, EQWT 1000; Isophorone Diisocyanate, IPDI (Veba); and Hydroxyethyl Acrylate (HEA) or Methacrylate, HEMA Rohm and Haas). Other suitable polyols which may be used are polycaproloctone and polyether polyols with an acceptable MW range for desired flexibility from 1000 to 3000. Aliphatic Diisocyanate, IPDI, is preferred over Aromacics for weatherability. Monoacrylate monomers could be used over diacrylate for achieving greater flexibility. The filler is used to block visible transparency and being a quartz filler allows for ultraviolet transparency to achieve a curing. Irqacure 651 is chosen for a thorough cure. The wax is melted and dispersed into the formula to allow for curing in air since the wax forms a thin film at the surface and blocks against oxygen which inhibits the surface cure. The pigment absorbs ultraviolet light and minimizes the coating thickness to 30 mils for effective curing. A 0.01% level of pigment imparts a grey or concrete color for matching to the surface color of concrete.

One of the key ingredients in the strip material 18 in the inductive loop 10 of the present invention is the ductile, flexible, extensible conductor 20. Since metals typically have been used as conductors and since metals are generally subject to breakage when stretched, the use of a metal for the conductor 20 has been a major problem in prior art surface mounted inductive loops. This is evidenced by the inductive loop described by Universal Autopayment where a multiplicity of conductive paths are provided so that when breakage occurs in some paths still other conductive paths will remain. The present invention has two alternative embodiments of a conductor which meets the ductile, flexible, extensible criteria.

Figure 7:
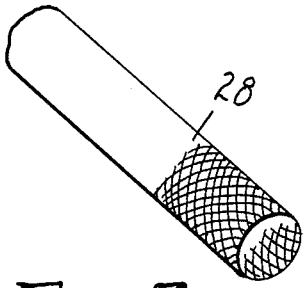
FIG. 7 illustrates an example of stock material out of which the conductor used in the strip material and inductive loop of the present invention is formed.
Figure 8:
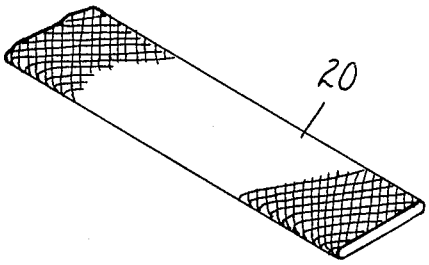
FIG. 8 shows the conductor formed from the stock material of FIG. 7 ready for use in the strip material and inductive, loop of the present invention.

The first embodiment for the conductor 20 is illustrated in FIGS. 7 and 8. FIG. 7 illustrates a standard, copper wire braid 28. Examples of two braids 28 which may be used are Model No. 8654 manufactured by Belden and Model No. 2163 manufactured by Alpha, both of which are braided 72 strand copper tinned wires. The standard wire braid 28 is then compressed and flattened before being utilized in the strip material 18 or the inductive loop 10 of the present invention. In a preferred embodiment, the wire braid 28 which originally was 12 inches (30.5 centimeters) in length is compressed to between approximately 6 inches (15.24 centimeters) and 9 inches (22.86 centimeters) in length and when flattened becomes $\frac{3}{8}$ inches (0.95 4 centimeters) wide instead of the original $\frac{1}{4}$ inch (0.64 centimeters) in width. The conductor 20 illustrated in FIG. 8 having been compressed and flattened from the conductive copper wire braid 28 in FIG. 7 has the extensible, flexible, ductile properties required.

Figure 9:
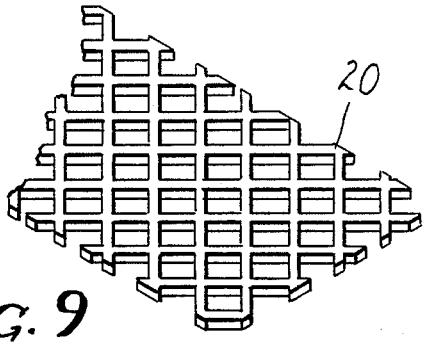
FIG. 9 shows a preferred form of the conductor to be utilized in the strip material and inductive loop of the present invention.

The second embodiment of the conductor 20 is illustrated in FIG. 9. Conductor 20 in FIG. 9 is constructed from a copper mesh having a number of voids and providing a lattice type design. Due to the presence of the voids in the copper mesh, the conductor 20 is subject to a considerable degree of extensibility. An example of a preformed copper mesh which is suitable for use as conductor 20 is material 4CU6-050 which has been flattened and annealed.

With both of the conductors 20 in FIGS. 8 and 9, it is preferable to have the conductors 20 either "tinned" or "anti-oxidized" to protect the conductors 20 against corrosive elements. Tinned copper is a well known process by which a tin coating is added to copper to aid in soldering and inhibit corrosion. Anti-oxidant is a well known substance which prevents or slows down oxidation of the material when the material is exposed to air.

Figure 10:
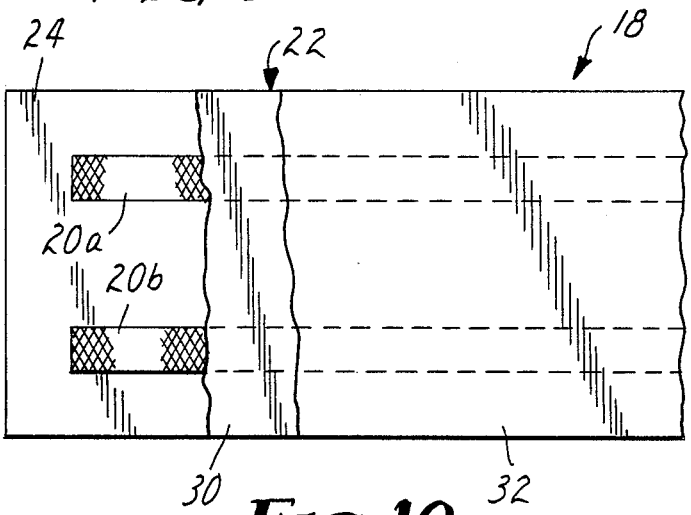
FIG. 10 illustrates an alternative construction of the strip material and inductive loop of the present invention utilizing dual,, conductors.

While the preferred embodiment of the inductive loop 10 is a preformed single turned loop formed from the strip material 18 with a single conductor as illustrated in FIGS. 4, 5, and 6 it is recognized that some installations may require a multiturn inductive loop and an inductive loop with a dual conductive material may be desirable for the lead wire 14 connecting the inductive loop 10 to the edge 16 of the road 12. FIG. 10 illustrates a strip material 18 which can be used for such a purpose. Strip material 18 as described in FIG. 10 can easily be used for either a multi-turn inductive loop 10 or for the lead wire 14. Strip material 18 in FIG. 10 is constructed very similarly to those constructions described in FIGS. 4 and 5 except that two conductors (20A and 20B) are contained therein. Accordingly the width of the strip material 18 may be increased to accommodate both conductors 20A and 20B. FIG. 10 illustrates the optional protective underlayment 24 and illustrates protective covering 22 containing the base sheet 30 and support film 32 construction described in Jorgensen, modified as described above. Alternatively conductors 20A and 20B may be laid directly on the surface of the roadway 12 itself, or protective underlayment 24 may be utilized which again may be an adhesive or the modified sheet material of Jorgensen. When a protective underlayment 24 is utilized, the protective underlayment 24 also serves to ensure insulation between conductors 20A and 20B.

Figure 11:
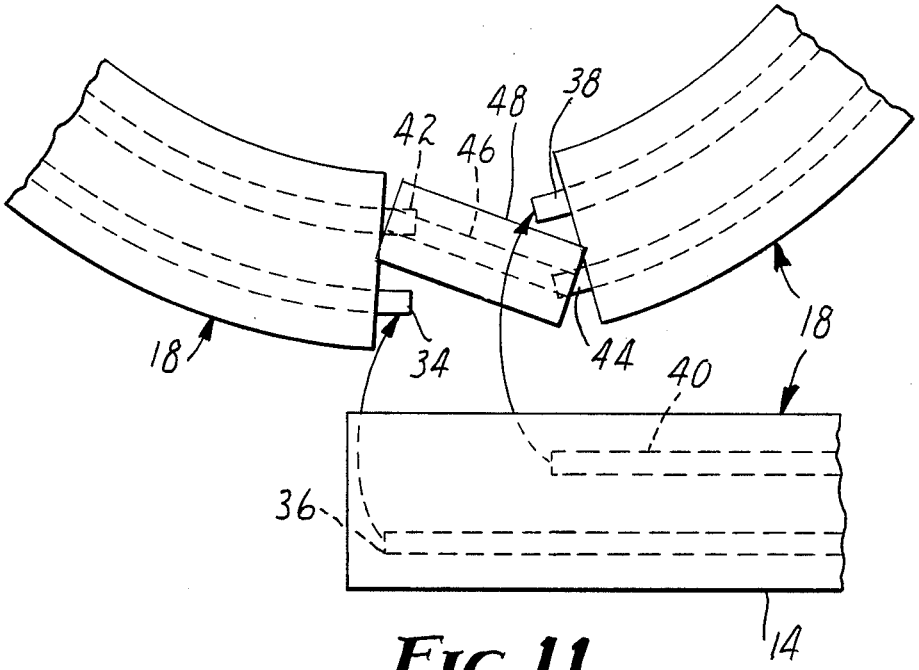
FIG. 11 shows one form of a splice and lead wire connection to a multiple turn inductive loop installation of the strip material of the present invention.

FIG. 11 illustrates one possible means of accommodating a splice should a multiple turn inductive loop 10 be desired to be constructed or should an inductive loop 10 be desired to be constructed from discrete portions of strip material 18. With the multi-turn inductive loop 10 illustrated in FIG. 11 conductor 34 must couple to conductor 36 in strip material 18 forming lead wire 14 while conductor 38 must connect with conductor 40 similarly. Meanwhile in order to form a continuous multiturn inductive loop, conductor 42 must couple directly to conductor 44. To accomplish the connection between conductor 42 and conductor 44, a separate piece of conductor 46, which may be constructed of the same material as conductor 20 as previously described, is laid diagonally between conductor 42 and conductor 44. The splice may be accomplished with solder lugs and allowed to cold flow to complete the electrical connection. Since conductor 36, in order to couple to conductor 34 must pass over the top of conductor 46 an insulator 48 must be placed over conductor 46 to protect it from conductor 36. It is preferred that insulator 48 be constructed from a polyurethane rubber sheet or from a fiberglass web. With insulator 48 in place strip material 18 forming lead wire 14 may be placed on top of the strip material 18 forming the inductive loop 10 with conductor 34 mating conductor 36 and conductor 38 mating conductor 40. Again, solder lugs and cold flow may be utilized to form the electrical connection.

Thus, it can be seen that there has been shown and described a novel strip material for forming an inductive loop. It is to be understood, however, that various changes, modifications and substitution in the form of the details of the described invention can be made by those skilled in the art without departing from the scope of the invention as described by the following claims:

What is claimed is:

1. An inductive loop adapted to be applied to the surface of a roadway, comprising:

a loop of a ductile, flexible, extensible, flattened, metallic mesh; and a protective covering adhered to said loop, said protective covering being capable of adhering said loop to said surface of said roadway.

2. An inductive loop as in claim 1 wherein said metallic mesh is a flattened braided wire.

3. An inductive loop as in claim 2 wherein said flattened braided wire is longitudinally compressed.

4. An inductive loop as in claim 3 wherein said flattened braided wire has been longitudinally compressed to be not more than three-fourths of its extended length.

5. An inductive loop as in claim 3 wherein said flattened braided wire is constructed from a soft metal.

6. An inductive loop as in claim 1 wherein metallic mesh is constructed from a soft metal.

7. An inductive loop as in claim 6 wherein said metallic mesh has a surface area containing of from 25 percent to 75 percent voids.

8. An inductive loop as in claim 7 wherein said metallic mesh is constructed by creating diamond-shaped voids in a metallic sheet.

9. An inductive loop as in claim 1 wherein said metallic mesh is treated with an anti-oxidant to deter corrosion.

10. An inductive loop as in claim 1 wherein said protective covering comprises:

a base sheet;

a support film adhered to one surface of said base sheet; and an adhesive affixed to the other side of said base sheet for adhering said wire to said protective covering and for being capable of adhering said inductive loop to said roadway.

11. An inductive loop as in claim 10 further comprising a protective underlayment placed between said conductor and said surface of said roadway.

12. An inductive loop as in claim 11 wherein said protective underlayment is insulative.

13. An inductive loop as in claim 12 wherein said protective underlayment is an adhesive.

14. A strip of material to be formed into an inductive loop adapted to be applied to the surface of a roadway, comprising:

a conductor of a ductile, flexible, extensible, flattened metallic mesh; and a protective covering being capable of adhering said conductor to said surface of said roadway.

15. A strip material as in claim 14 wherein said metallic mesh is a flattened braided wire.

16. A strip material as in claim 15 wherein said flattened braided wire is longitudinally compressed.

17. A strip material as in claim 16 wherein said flattened braided wire has been longitudinally compressed to be not more than three-fourths of its extended length.

18. A strip material as in claim 15 wherein said flattened braided wire is constructed from a soft metal.

19. A strip material as in claim 14 wherein metallic mesh is constructed from a soft metal.

20. A strip material as in claim 19 wherein said wire mesh has a surface area containing of from 25 percent to 75 percent voids.

21. A strip material as in claim 20 wherein said metallic mesh is constructed by creating diamond-shaped voids in a metallic sheet.

22. A strip material as in claim 14 wherein said metallic mesh is treated with an anti-oxidant to deter corrosion.

23. A strip material as in claim 14 wherein said protective covering comprises:

a base sheet;

a support film adhered to one surface of said base sheet; and an adhesive affixed to the other side of said base sheet for adhering said wire to said protective covering and for being capable of adhering said inductive loop to said roadway.

* * * * *